US010058725B2

(12) United States Patent
LaCaze

(10) Patent No.: US 10,058,725 B2
(45) Date of Patent: Aug. 28, 2018

(54) HANDHELD RESISTANCE EXERCISE DEVICE AND METHODS OF EXERCISING THEREWITH

(71) Applicant: John Joseph LaCaze, Opelousas, LA (US)

(72) Inventor: John Joseph LaCaze, Opelousas, LA (US)

(73) Assignee: Blu Sky Solutions, LLC, Opelousas, LA (US)

( * ) Notice: Subject to any disclaimer, the term of this patent is extended or adjusted under 35 U.S.C. 154(b) by 0 days.

(21) Appl. No.: 15/648,612

(22) Filed: Jul. 13, 2017

(65) Prior Publication Data

US 2017/0304669 A1 Oct. 26, 2017

Related U.S. Application Data

(63) Continuation-in-part of application No. 15/055,899, filed on Feb. 29, 2016.

(51) Int. Cl.
*A63B 21/015* (2006.01)
*A63B 21/02* (2006.01)
(Continued)

(52) U.S. Cl.
CPC ..... *A63B 21/023* (2013.01); *A63B 21/22* (2013.01); *A63B 21/4035* (2015.10);
(Continued)

(58) Field of Classification Search
CPC ..... A63B 21/00069; A63B 21/00072; A63B 21/00076; A63B 21/023; A63B 21/025; A63B 21/04; A63B 21/045; A63B 21/0455; A63B 21/1465; A63B 21/1496; A63B 21/22; A63B 22/14; A63B 22/18; A63B 22/185; A63B 23/02; A63B 23/0205; A63B 23/0216; A63B 23/0482; A63B 2023/003; A63B 26/003; A63B 26/006;
(Continued)

(56) References Cited

U.S. PATENT DOCUMENTS 3,428,311 A 2/1969 Mitchell
3,911,907 A 10/1975 Smith, Jr. ..... A61H 1/02 482/1
(Continued)

OTHER PUBLICATIONS

Information Disclosure Statement and Notice of References for priority case 14/711,539.

*Primary Examiner* — Gregory Winter
(74) *Attorney, Agent, or Firm* — Charter IP LLC; Matthew J. Lattig

(57) ABSTRACT

A handheld resistance exercise device is contemplated for exercise, rehabilitation, warm-up and the like, which provides resistance to muscles, tendons, joints, and fasciae in the upper body and lower back as it is actuated by a user standing a distance away from a vertical surface that is engaged with the device. Actuation thereof by the user in performing various exercise protocols provides stability for one or more muscles of the hand, elbow, shoulder girdle, shoulder blade, rib cage, as well as the inner core muscles, while also providing improved mobility for one or more of the wrist, forearm, elbow, shoulder joint, and muscles that rotate and bend the spine sideways.

19 Claims, 11 Drawing Sheets

(51) Int. Cl.
*A63B 21/00* (2006.01)
*A63B 21/22* (2006.01)
*A63B 23/12* (2006.01)
*A63B 23/14* (2006.01)

(52) U.S. Cl.
CPC ..... *A63B 21/4049* (2015.10); *A63B 23/1209* (2013.01); *A63B 23/14* (2013.01)

(58) Field of Classification Search
CPC ..... A63B 23/1209; A63B 23/1245–23/1281; A63B 21/015; A63B 21/169; A63B 2208/0295; A63B 23/14; A63B 23/16; A63B 23/03533; A63B 23/1236; A63B 22/205; A63B 2022/185; A63B 69/0057; A63B 21/0407–21/0435
USPC ..... 482/141, 146, 147
See application file for complete search history.

(56) References Cited

U.S. PATENT DOCUMENTS 4,200,282 A 4/1980 Agyagos ..... A63B 17/00 482/147
4,319,749 A 3/1982 Agyagos ..... A63B 22/14 482/147
4,768,778 A 9/1988 Thomas, Jr. ..... A63B 22/14 482/141
4,770,409 A 9/1988 Wallisch
4,953,858 A 9/1990 Zelli ..... A63B 21/023 482/147
5,002,272 A 3/1991 Hofmeister ..... A63B 21/028 482/127
5,147,265 A 9/1992 Pauls ..... A63B 21/015 482/115
5,683,337 A 11/1997 Zetocha ..... A63B 22/14 482/146
5,692,323 A 12/1997 Goldberg ..... A43B 3/0042 36/115
5,879,275 A 3/1999 Aruin ..... A63B 22/14 282/146
6,837,838 B2 1/2005 List ..... A63B 21/169 482/146
7,896,789 B2 3/2011 Hinton ..... A63B 21/00047 482/141
7,909,716 B2 3/2011 Gant
7,909,747 B1 3/2011 LaCaze ..... A63B 21/00196 482/142
7,935,039 B2 5/2011 Dannenberg ..... A63B 22/14 482/141
8,986,180 B1 3/2015 VanBuren ..... A63B 4/00 482/145
9,358,414 B2 6/2016 Dephouse ..... A63B 21/0004
9,358,419 B1 6/2016 Smith ..... A63B 21/06
2004/0266593 A1 12/2004 Schwendeman ..... A63B 23/12 482/140
2005/0148450 A1 7/2005 Huang ..... A63B 22/14 482/147
2006/0014615 A1* 1/2006 Godbold ..... A63B 21/00047 482/141
2007/0184951 A1 8/2007 James ..... A63B 21/4035 482/141
2010/0317496 A1 12/2010 Abranchess ..... A63B 21/0004 482/141
2011/0287914 A1 11/2011 Morris ..... A63B 21/00069 482/147
2011/0312479 A1* 12/2011 Caponigro ..... A63B 21/025 482/147
2015/0258364 A1 9/2015 Hetzel ..... A63B 23/0355 482/141

* cited by examiner

PRIOR ART

HANDHELD RESISTANCE EXERCISE DEVICE AND METHODS OF EXERCISING THEREWITH

CROSS-REFERENCE TO RELATED APPLICATIONS

The present application claims the benefit under 35 U.S.C. § 120 and is a continuation-in-part of U.S. patent application Ser. No. 15/055,899 to the inventor, filed Feb. 29, 2016, which in turn is a continuation-in part of U.S. patent application Ser. No. 14/920,905 to the inventor, filed Oct. 23, 2015, now U.S. Pat. No. 9,295,873, which in turn is a continuation-in-part of U.S. patent application Ser. No. 14/711,539 to the inventor, filed May 13, 2015, now U.S. Pat. No. 9,393,458. U.S. patent application Ser. No. 14/711,539 additionally claimed the benefit under 35 U.S.C. § 119(e) of U.S. Provisional Patent Application Ser. No. 62/126,461 to the inventor, filed Feb. 28, 2015. The entire contents of each of the above-noted applications is hereby incorporated by reference herein.

BACKGROUND

Field

The example embodiments in general are directed to a handheld resistance exercise device for the upper body, more particularly to an exercise device which provides resistance to muscles, tendons, joints, and fasciae in the upper body and lower back as it is actuated by a user standing a distance away from a vertical surface that is engaged with the device, in which actuation thereof by the user in performing various exercise protocols provides stability for one or more muscles of the hand, elbow, shoulder girdle, shoulder blade, rib cage, as well as the inner core muscles, while also providing improved mobility for one or more of the wrist, forearm, elbow, shoulder joint, and muscles that rotate and bend the spine sideways. The example embodiments are also directed to various methods or exercise protocols of exercising with the device to achieve the above-noted stability and mobility improvements achievable therefrom.

Related Art

Various types of conventional exercise and/or therapy devices have been developed to provide an effective means for supplying resistance and movement to a person's body for keeping fit by working out against a given resistance, either self-imposed, with an external force, or via rotation. Typically, these conventional exercise devices are configured so as to exercise or rehabilitate different parts of the human body using some type of force, sometimes in the form of weights and/or energy creating resistance.

FIGS. 1 through 3 illustrate just one conventional multi-use physical fitness device equipped, in this case a device equipped with roller ball transfers in order to perform various exercises. As shown, an exercise roller assembly device ("exercise device 10") includes three legs 11, 12, 13 connected to a base 19, with a handle assembly 14 rotatable relative to base 19 or rigidly connected to part of the base 19. The legs 11-13 extend upwardly along backs 20 to shelves 21, from which the rollers 22 connect to a bottom surface 23 of the shelves 21.

Conventionally, exercise device 10 is employed for curls or other exercises performed using handles, such as push-ups and for performing other exercises using legs, arms, and/or other parts of the body including the chest, back, legs, and the like. However, use of the exercise device 10 is undesirable when attempting to perform any type of exercises in which the device 10 is needed to be static or fixed in place by a user against a planar surface, due to the rollers 22. Hence, any exercise performed using exercise device 10, due to its design, imparts inherent instability to muscles in the user as device 10 is rolling on a flat surface. As such, exercise device 10 is unable to be used to perform desired exercise protocols that will provide both stability and mobility to certain muscles, tendons, joints, and fasciae in the upper body and lower back as contemplated hereafter.

Consequently, in order to overcome the deficiencies noted in FIGS. 1 to 3, what is needed is a handheld resistance exercise device and exercise protocols therefor, where the device is adapted to be placed in fixed engagement against a vertical surface by a standing user in order to achieve both stability and mobility improvements for muscles, tendons and joint in the user's upper body and lower back.

SUMMARY

An example embodiment of the present invention is directed to an exercise device which comprises a hollow base, a rotatable plate provided on top of the base and having a handle attached thereon for access by the hand of a user, and a resistance mechanism arranged between the base and rotatable plate. The resistance mechanism further includes a spring centrally located within the base and terminating in oppositely-extending spring tine ends that are adapted to provide resistance and release of resistance against rotation of the rotatable plate by the user. The resistance mechanism also includes a first ramp provided in the base around the spring with flared ends serving as stops, each tine end of the spring biased against a corresponding flared end of the first ramp. The resistance mechanism further includes a second ramp attached to an underside surface of the rotatable plate so as to be in adjacent relation to the first ramp and adapted to travel in either direction along an inside wall surface of the first ramp. A respective end edge of the second ramp is adapted to come into contact with one of the oppositely-extending spring tine ends depending on the direction of rotation of the plate.

Another example embodiment is directed to a handheld resistance exercise device usable by a user to improve stability and mobility in muscles, tendons, joints, and fasciae in the upper body and lower back thereof, the device supportable by the user in fixed relation against a vertical planar surface for exercise. The device includes a hollow base having a central circular opening in a top surface thereof that is bounded by a circumferential inner vertical wall to define a cavity therein, the top surface of the base including a plurality of separate legs extending outward from the cavity, each leg terminating in a foot at a distal underside end thereof that comes into flush contact with the vertical planar surface as the device is held in fixed contact against the vertical planar surface by the user for exercise. The device also includes a rotatable plate provided on top of the base over the cavity, an outer surface thereof serving as the top surface of the device and having a handle attached thereon for access by the hand of the user, and a resistance mechanism arranged within the cavity so as to be sandwiched between and attached to each of the base and rotatable plate. The resistance mechanism further includes a single spring centrally located in the center of the cavity and terminating in oppositely-extending spring tine ends, the tine ends of the spring adapted to provide resistance and release of resistance against rotation of the plate by the user, a first semicircular ramp, and a second semicircular ramp. The first semicircular ramp is arranged in the cavity between the circumferential inner vertical wall of the base and the central spring, and has flared ends serving as stops, each tine end of the central spring biased against a corresponding stop of the first ramp. The second semicircular ramp extends from an underside surface of the plate so as to be in adjacent relation to the first semicircular ramp and adapted to travel in either direction along an inside wall surface of the first ramp. A respective end edge of the second ramp is adapted to come into contact with one of the oppositely-extending spring tine ends depending on the direction of rotation of the plate. Thus, only one tine end of the spring applies resistance against rotation of the plate at any one time depending on the direction of rotation.

BRIEF DESCRIPTION OF THE DRAWINGS

Example embodiments will become more fully understood from the detailed description given herein below and the accompanying drawings, wherein like elements are represented by like reference numerals, which are given by way of illustration only and thus are not limitative of the example embodiments herein.

DETAILED DESCRIPTION

Figure 1:
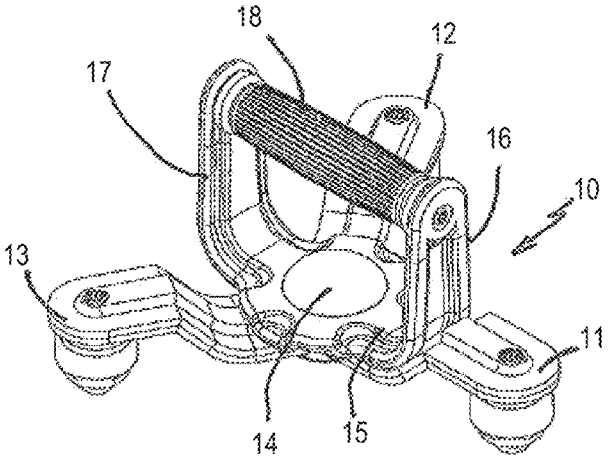
FIG. 1 PRIOR ART
FIG. 1 is a front perspective view of a conventional multi-use physical fitness device for performing various exercises.
Figure 2:
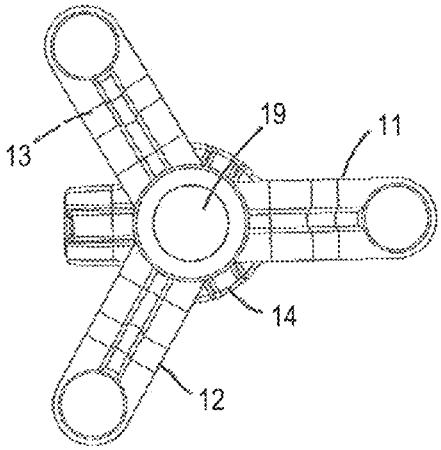
FIG. 2 PRIOR ART
FIG. 2 is a bottom plan view of the device in FIG. 1.
Figure 3:
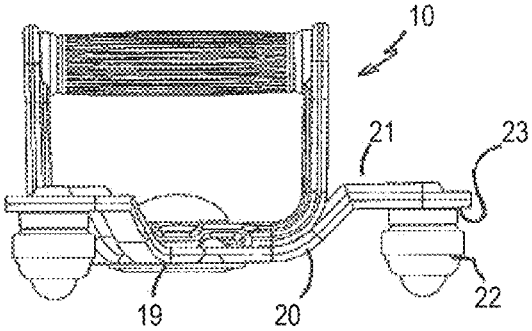
FIG. 3 is a side plan view of the device as shown in FIGS. 1 and 2.

In the following description, certain specific details are set forth in order to provide a thorough understanding of various example embodiments of the disclosure. However, one skilled in the art will understand that the disclosure may be practiced without these specific details. In other instances, well-known structures associated with manufacturing techniques have not been described in detail to avoid unnecessarily obscuring the descriptions of the example embodiments of the present disclosure.

Unless the context requires otherwise, throughout the specification and claims that follow, the word "comprise" and variations thereof, such as "comprises" and "comprising," are to be construed in an open, inclusive sense, that is, as "including, but not limited to."

Reference throughout this specification to "one example embodiment" or "an embodiment" means that a particular feature, structure or characteristic described in connection with the embodiment is included in at least one embodiment. Thus, the appearances of the phrases "in one example embodiment" or "in an embodiment" in various places throughout this specification are not necessarily all referring to the same embodiment. Further, the particular features, structures or characteristics may be combined in any suitable manner in one or more example embodiments.

As used in this specification and the appended claims, the singular forms "a," "an," and "the" include plural referents unless the content clearly dictates otherwise. The term "or" is generally employed in its sense including "and/or" unless the content clearly dictates otherwise.

As used in the specification and appended claims, the terms "correspond," "corresponds," and "corresponding" are intended to describe a ratio of or a similarity between referenced objects. The use of "correspond" or one of its forms should not be construed to mean the exact shape or size. In the drawings, identical reference numbers identify similar elements or acts. The size and relative positions of elements in the drawings are not necessarily drawn to scale.

In general, an example handheld exercise resistance device ("device 100") as to be described in more detail hereafter is adapted for use against a vertical flat or planar surface such as a wall or door. Not only does the vertical surface assist with balance and support for the user, but it also serves as a brace so that the user may selectively add sufficient resistance through various exercise protocol repetitions to the rotation of a handle on device 100 while maintaining their upper body stable (which cannot be accomplished otherwise). Example target areas in the upper body and lower back which may be exercised by a user of the example device to enhance stability thereof may include but are not limited to muscles of the hand, elbow, shoulder girdle, shoulder blade, rib cage, as well as the inner core muscles. Exercise protocols using device 100 also provide improved mobility for one or more of the wrist, forearm, elbow, shoulder joint, and muscles that rotate and bend the spine sideways. Moreover, the example device 100 is specifically adapted to the user based on physiology and biomechanics principles in order to facilitate injury prevention and rehabilitation after injury.

Before discussing the example embodiments in detail, an understanding of skeletal muscles in the body is provided, and more specifically certain muscles, joints, tendons and ligaments present in the human upper body. Skeletal muscle is made up of bundles of individual muscle fibers called myocytes. Each myocyte contains many myofibrils, which are strands of proteins (actin and myosin) that can grab on to each other and pull. This shortens the muscle and causes muscle contraction. Muscle contractions occur when a muscle fiber or group of fibers is activated by a nerve to increase the tension within the muscle.

The human muscles are made of bundles of muscle fibers that contain thousands of smaller structures called myofibrils, where the actual contraction occurs. Within myofibrils, there are two types of filaments, called actin and myosin. The sliding filament theory explains that when a muscle is activated and movement occurs, these two interlocking filaments can grab onto each other and pull, which causes the myofibril to shorten. This shortening is called a muscle contraction.

There are three ways a muscle fiber can be activated, e.g., three types of muscle contractions. Two allow for movement in the muscle and one simply creates tension, without joint movement. The three contraction types include: concentric muscle contraction (shortening); eccentric muscle contraction (lengthening); and isometric muscle contraction (static). It is generally accepted that muscle fiber types may be broken down into two main types: (a) slow twitch (Type I) muscle fibers; and (b) fast twitch (Type II) muscle fibers. Fast twitch fibers can be further categorized into Type IIa and Type IIb fibers.

A slow-twitch or Type I muscle fiber can be understood as a muscle fiber that develops less tension more slowly than a fast-twitch fiber. The slow-twitch fiber is usually fatigue resistant and has adequate oxygen and enzyme activity. Studies indicate that world-class endurance runners apparently have high percentages of slow-twitch fibers, known as "red muscle" due to the abundance of capillaries serving the fiber muscle. This muscle type also has high amounts of the protein myoglobin, which functions to store oxygen inside the muscle cell. This, slow-twitch muscles are more efficient at using oxygen to generate more fuel (known as "ATP") for continuous, extended muscle contractions over a long period of time. Slow-twitch fibers fire more slowly than fast-twitch fibers and can go a long time before fatigue. Accordingly, slow-twitch fibers are great at helping athletes run marathons or bicycle for hours.

A fast-twitch or Type II muscle fiber can be understood as a muscle fiber that develops high tension rapidly. It is usually innervated by a single alpha neuron and has low fatigue resistance, low capillary density, low levels of aerobic enzymes, and low oxygen availability. Fast-twitch fibers are used in activities such as sprinting, jumping, and weightlifting.

These distinctions seem to influence how muscles respond to training and physical activity, and each fiber type is unique in its ability to contract in a certain way. Human muscles contain a genetically determined mixture of both slow and fast fiber types. On average, humans have about 50 percent slow-twitch and 50 percent fast-twitch fibers in most of the muscles used for movement.

A human's muscle fiber type may influence what sports they naturally excel at or whether one is fast or strong. Olympic athletes tend to fall into sports that match their genetic makeup. Olympic sprinters have been shown to possess about 80% fast-twitch fibers, while those who excel in marathons tend to have 80% slow-twitch fibers.

As shown fully hereafter, the example device 100 and associated exercise protocols therewith is designed specifically to activate and strengthen Type II muscle groups and its surrounding fasciae while simultaneously inhibiting and releasing Type I muscle groups and its surrounding fasciae. As research, literature and muscle biopsy reveals, skeletal muscles, i.e., the muscles that move joints, can be divided into two distinct categories. Each category can be referred to correctly with any of the following terms, relative to each other: (a) Type I—also described as tonic, postural, overactive, red muscle, slow-twitch. These have a tendency to be short relative to its Type II counterpart; these Type I muscles may be considered "Mechanically Advantaged"; and (b) Type II—also described as phasic, powerful mover, under active, white muscle, fast-twitch. These have a tendency to be long relative to its Type 1 counterpart; these Type II muscles may be considered "Mechanically Disadvantaged".

As to be described hereafter, the example handheld exercise resistance device and associated exercise protocol methodologies therewith and is designed to activate and strengthen Type II muscles, or under active and mechanically disadvantaged muscles, and their surrounding fasciae, while simultaneously inhibiting and releasing Type I muscles, or overactive and mechanically advantaged muscles, and their surrounding fasciae. Type I muscles are mechanically advantaged over their counterpart Type II muscles, e.g., shoulder flexor muscles are highly mechanically advantaged over shoulder extensor muscles. Unless specific action is taken to activate and strengthen mechanically disadvantaged muscles, joints will be controlled predominately by the mechanically advantaged Type I muscles and joints will lose motion in all other axes except those controlled by the mechanically advantaged muscles.

As one example, the muscles that move the shoulder include pectoralis major (shoulder protractor), which is mechanically advantaged over the rhomboids (shoulder retractors); upper trapezius and elevator scapulae (shoulder elevators), which are mechanically advantaged over serratus anterior, pectoralis minor and lower trapezius (shoulder depressors); and latissimus dorsi, subscapularis, teres major (shoulder internal rotators), which are mechanically advantaged over the infraspinatus and teres minor (shoulder external rotators).

If allowed to follow a natural progression set up by anatomical makeup and lifestyle, the shoulders will develop a forward, upward and inward rotated position. This position is a fertile environment for strain and injury to the muscles around the shoulder and the shoulder joint (called the glenohumeral joint) itself. This poor position is also the major contributor to a forward head position and issues of the neck and cervical spine. Within the United States, this faulty shoulder position is pandemic.

As to shoulder girdle and shoulder joint muscles, achieving a certain position on hands and knees allows the overactive Muscles (Type I) to completely relax while the under active muscles (Type II) are strongly activated and strengthened. Example Type II muscles in the shoulder girdle and joint that may be strongly activated and strengthened using device 100 and an associated shoulder exercise protocol include infraspinatus, teres minor, serratus anterior, lower trapezius, posterior deltoid, pectoralis minor and rhomboids. Example Type I muscles in the shoulder girdle and joint that may be inhibited and released using device 100 and associated exercise protocols include pectoralis major, upper trapezius, elevator scapula, latissimus dorsi, subscapularis, teres major, and anterior deltoid. This exercise, in using device 100, has proved beneficial in returning the shoulder girdle and shoulder joint to a normal position and helpful in maintaining that position.

FIGS. 4-10 are various views provided to further describe the example handheld exercise resistance device 100 according to the example embodiment, and FIGS. 11 through 22 describe exercise protocols utilizing device 100. In general, device 100 is configured so as to increase strength and stability around the muscles, tendons, joints, and fasciae of the shoulders and forearms of the upper body, as well as certain back muscles and many of the small muscles in the lower back around the spine. Device 100 is utilized with a user standing and placing device 100 against a vertical surface, which may be smooth and flat/planar, and or flat but with a textured composition. Examples include a wall, door, and the like.

Referring primarily to FIGS. 4-10 with occasional reference to FIGS. 11-22, device 100 includes a hollow base 110 having a plurality of legs 115 designed to come into flush contact with a vertical planar surface 180 when held in contact therewith by a user 175. The device 105 further includes a rotatable plate 130 on the base 110, a handle 150 attached to the plate 130 and designed to be grasped at its handle grip part 151 by a hand 176 of the user 175, and a resistance mechanism (shown generally by arrow 140) within the base 110 for providing resistance and release of resistance against rotation of the plate 130. This is provided so that the user 175 is enabled to perform a given exercise to activate selected under active muscles and release selected overactive muscles in the forearm, shoulder and back.

As to be described in more detail hereafter, the resistance mechanism 140 includes a single spring 146 terminating in oppositely-extending spring tine ends 147. The tine ends 147 are adapted to provide resistance and release of resistance against rotation of the plate 130 by the user 175. Of note, only one tine end 147 of the spring 146 applies resistance against rotation of the plate 130 at any given moment, depending on the direction of rotation, so that the spring 146 never suffers fatigue or strain. In this design, spring 146 is thus only subject to compression and never any form of expansion, extending its lifetime.

Figure 8:
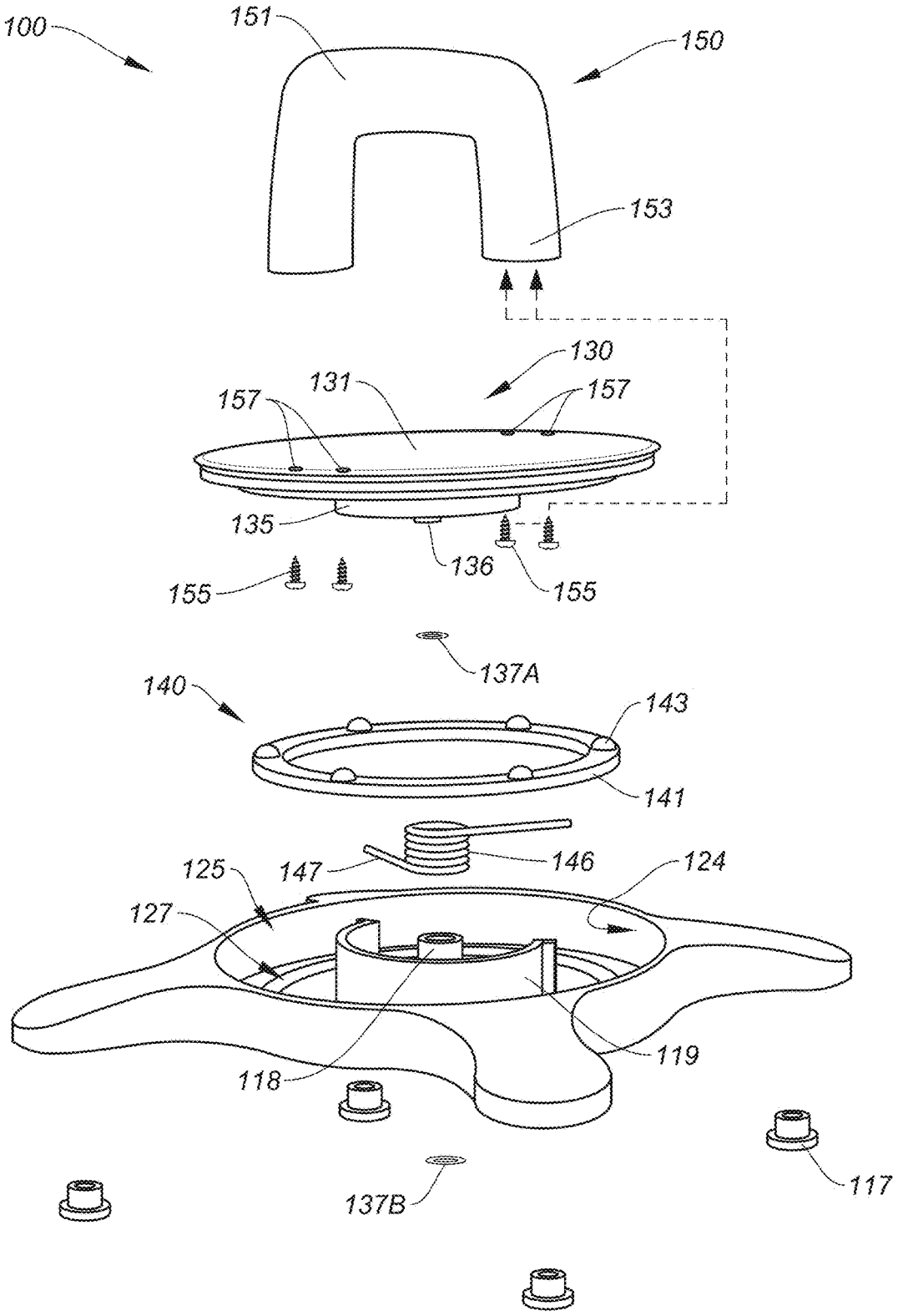
FIG. 8 is an exploded parts view of the device of FIG. 4.
Figure 9:
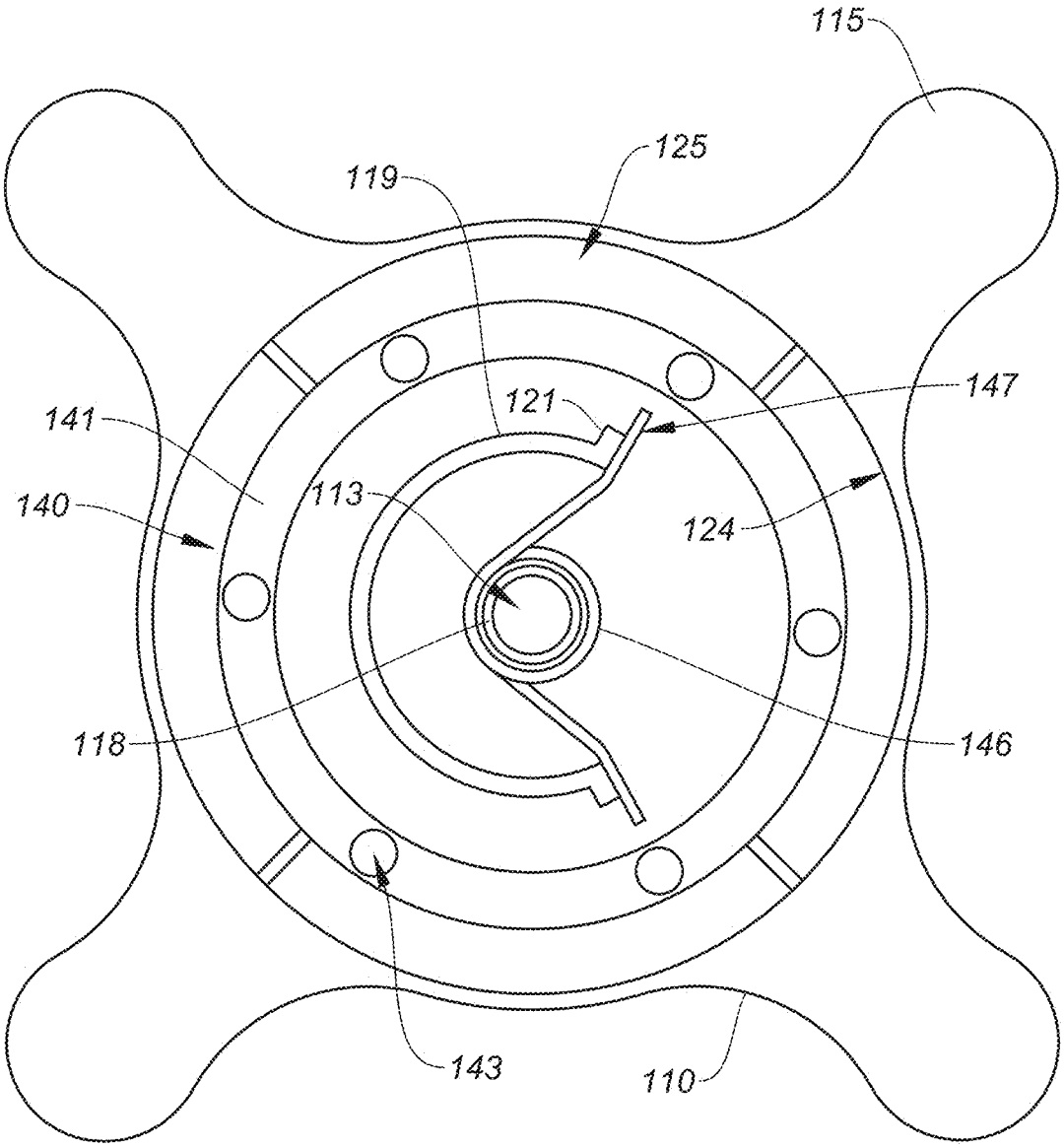
FIG. 9 is a top perspective view of the device of FIG. 4 with the rotatable plate removed to show interior components within the cavity of the base.
Figure 10:
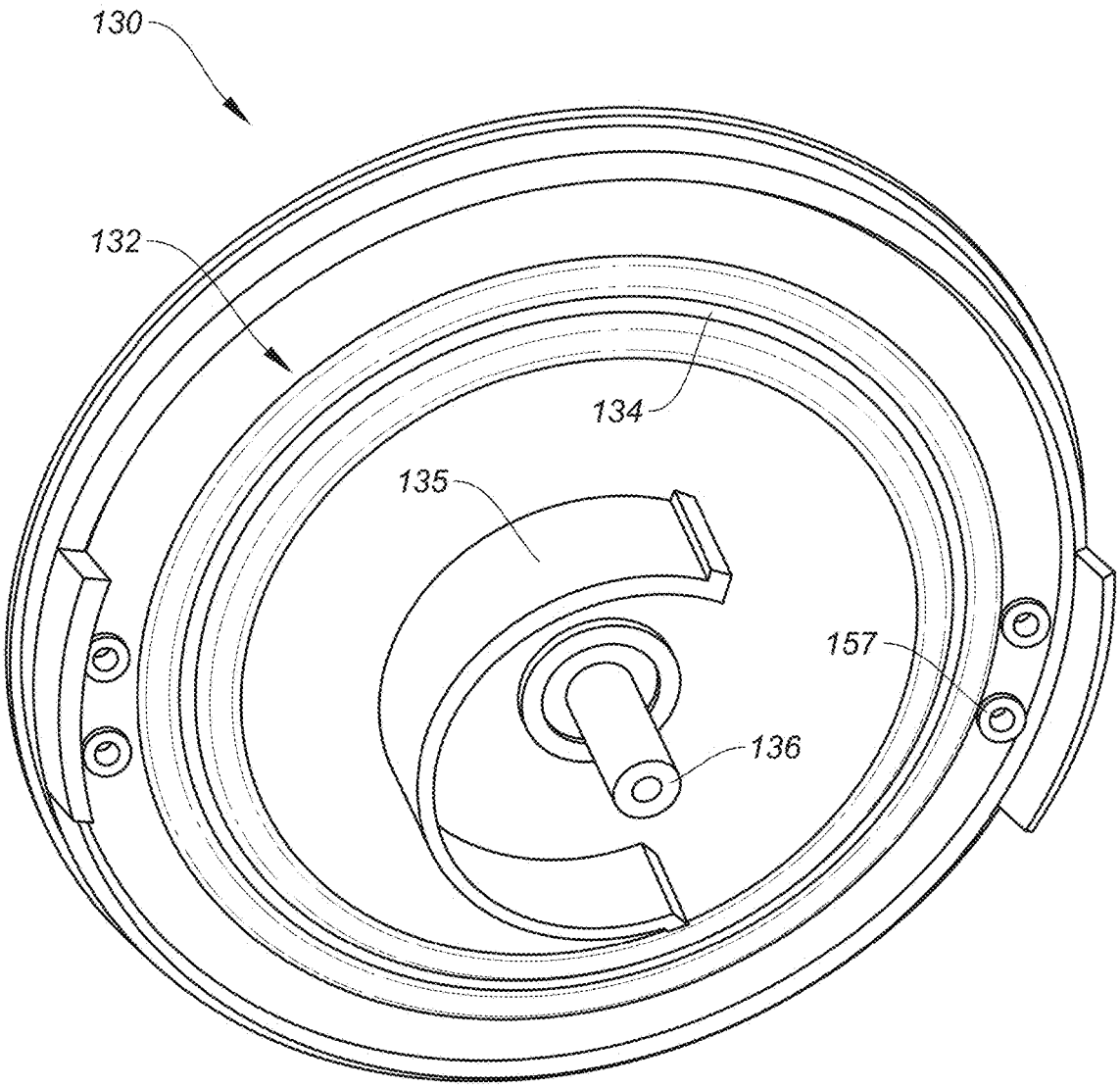
FIG. 10 is a bottom plan view of the rotatable plate of the device in FIG. 4 to illustrate structural components on an underside thereof in further detail.

Each leg 115 of base 110 includes structural ribs 116 and an elastomeric (such as rubber or plastic) foot 117 provided on the underside at a distal end of each leg 115 for contacting the vertical surface 180. As best shown in FIGS. 8-10, the plate 130 has a top surface 131 with sets of apertures 157 provided for accommodating legs 153 of the handle 150; these are secured to plate 130 via fasteners 155. The plate 130 further includes a center post 136 formed on an underside surface 132 thereof. As best shown in FIG. 8, the post 136 extends through first washers 137A, through an opening 113 (see FIGS. 6 and 9) of a central hollow columnar extrusion 118 that is adapted to receive the center post 136, and through a second washer 137B. The distal end of the center post 136 is secured by a fastener 114 centrally through a bottom surface 112 of the base 110, so that the rotatable plate 130 is attached both to the base 110 and to components which comprise the resistance mechanism 140.

Figure 6:
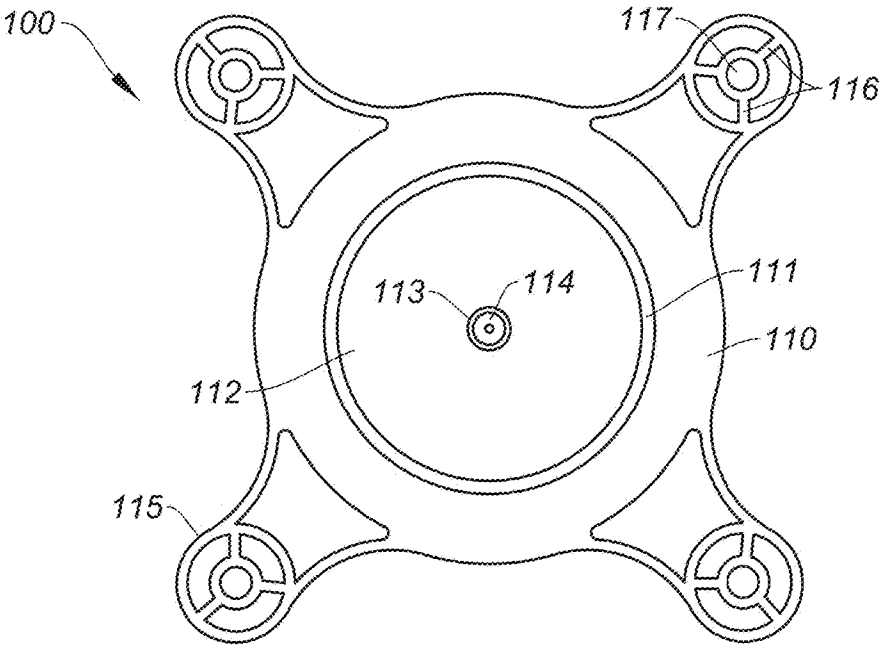
FIG. 6 is a bottom plan view of the device of FIG. 4.
Figure 5:
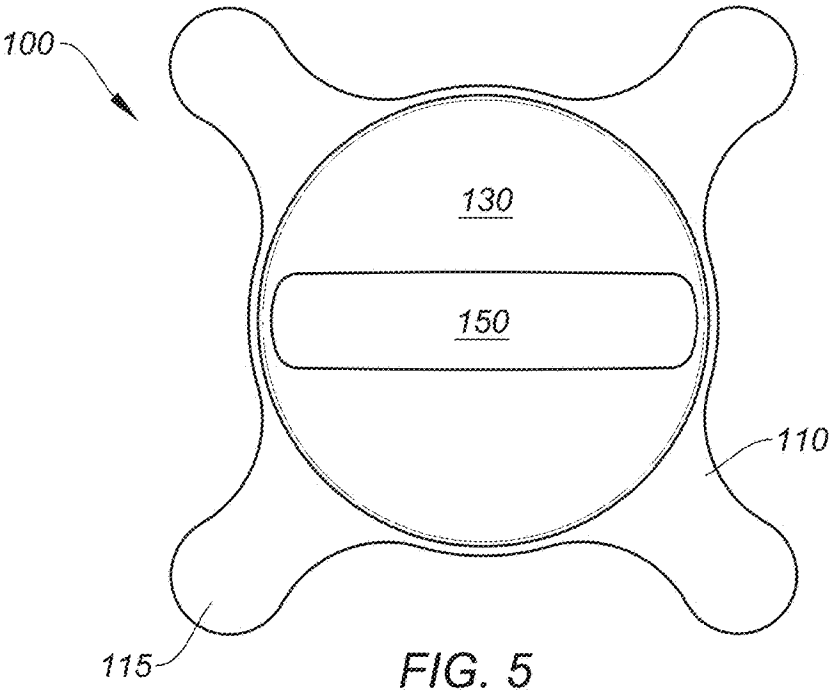
FIG. 5 is a top plan view of the device of FIG. 4.
Figure 7:
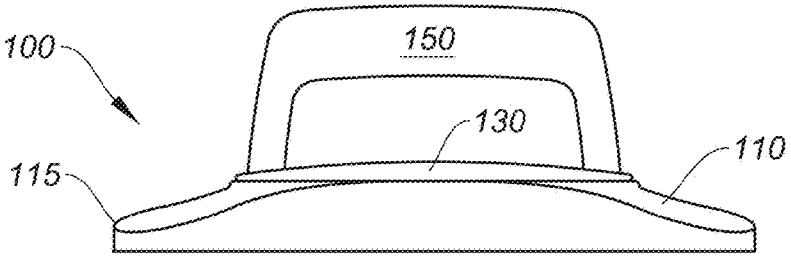
FIG. 7 is a left-side elevational view of the device of FIG. 4, the right-side elevational view being a mirror image thereof.

Referring to FIGS. 6 and 9, base 110 has a central circular opening 111 formed therein that is bounded by a circumferential inner vertical wall 124 to define a cavity 125 therein, with the aforementioned separate legs 115 extending outward and terminating in the feet 117 that come into flush contact with the vertical wall surface 180 when the device 100 is held there fixedly in place by the user 175. The cavity 125 contains selected components of the resistance mechanism 140, which is essentially sandwiched between the base 110 and rotatable plate 130 and cooperate with other components of the resistance mechanism provided on plate 130. As shown in FIGS. 9 and 10, the internal surface 132 of plate 130 has a circular grooved rib 134 formed thereon that is adapted to ride on a circular bearing ring 141 within cavity 125 as the user 175 rotates handle 150. The bearing ring 141 has a width and a top surface on which is formed a plurality of spaced hemispherical fixed bearings 143 integral with bearing ring 141 to facilitate rotation of the plate 130 relative to the fixed base 110.

The resistance mechanism 140 further includes a single spring 146 centrally located in cavity 125 and disposed on the outer surface of or otherwise captured by the columnar extrusion 118. Spring 146 terminates in oppositely-extending spring tine ends 147. These tine ends 147 (under bias or a force applied there against) are what provide resistance and release of resistance against rotation of the plate 130 by the user 175.

Resistance mechanism 140 additionally includes a first semicircular ramp 119 integral with base 110 and arranged in the cavity 125 between the circumferential outer vertical wall 124 and the central spring 146. Ramp 119 terminates into a flared end or stop 121 at either end. Each tine end 147 is biased against a corresponding stop 121 of the first semicircular ramp 119.

Resistance mechanism 140 additionally includes a second semicircular ramp 135 extending downward into cavity 125 from the underside surface 132 of the plate 130. It is in adjacent relation to the first ramp 119 (e.g., spooning relationship) so as to travel along a curved path in either direction, adjacent to and along an inside vertical wall of the first ramp 119. As best seen in FIG. 10, a given respective edge or end of the second ramp 136 is adapted to come into contact to or bear on a spring tine end 147, depending on the direction of rotation of the plate 130, with the spring 136 via its tine end 147 providing resistance there against.

Namely, as the plate 130 is rotated by a hand of user 175, one end of second ramp 135 comes into contact with a corresponding spring tine end 147 that is held in tension (biased) against its corresponding stop 121 of the first ramp 119; this prevents further rotation in that particular direction (and vice versa in the other direction). Thus, only one tine end 147 of the spring 146 actually applies resistance against rotation of the plate 130 at any one time, depending on the direction of rotation, so that the central spring 146 only compresses to impart resistance and never expands.

FIGS. 11 through 22 are provided to illustrate how a user may perform certain exercise protocols using device 100 so as to activate selected under active muscles and release selected overactive muscles. Namely, the user 175 performs movements in accordance with these protocols using device 100 in order to inherently effect myofascial balance therebetween.

Figure 4:
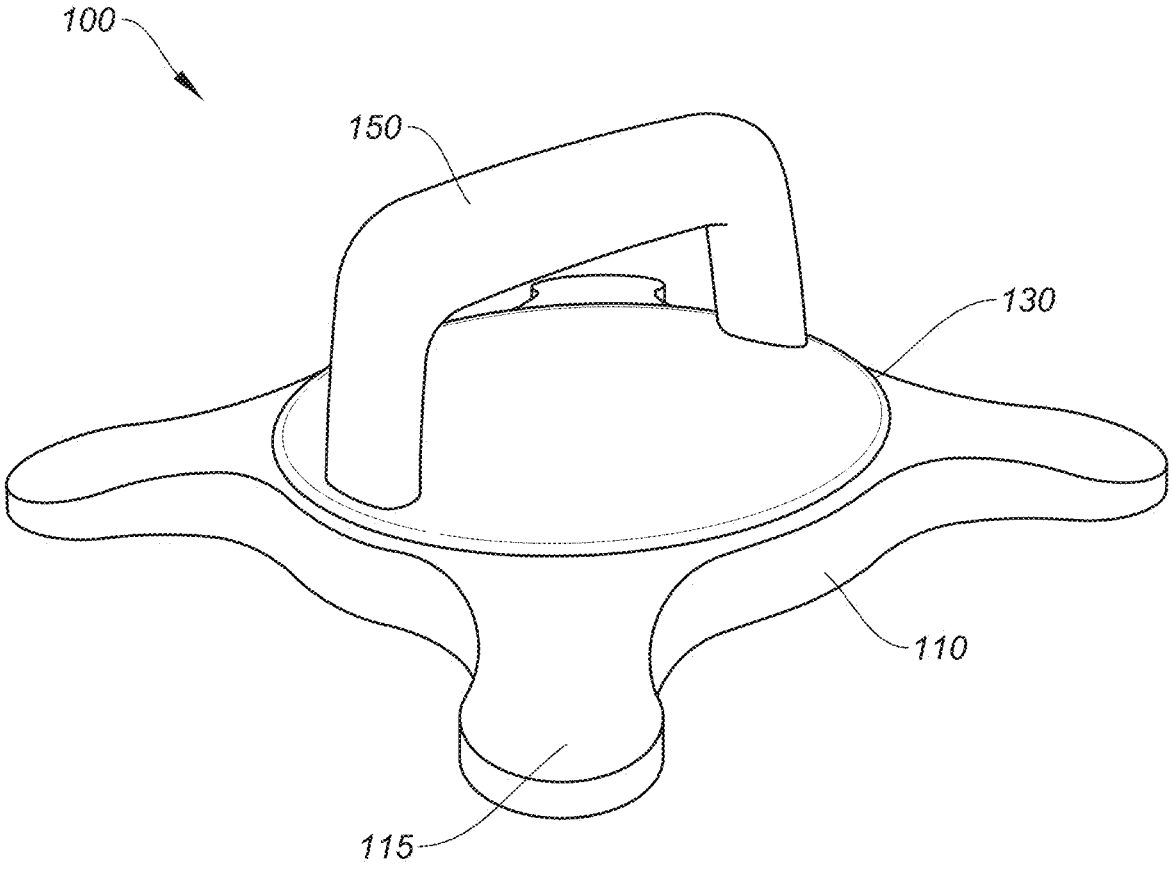
FIG. 4 is a perspective view of handheld resistance exercise device according to an example embodiment.
Figure 11:
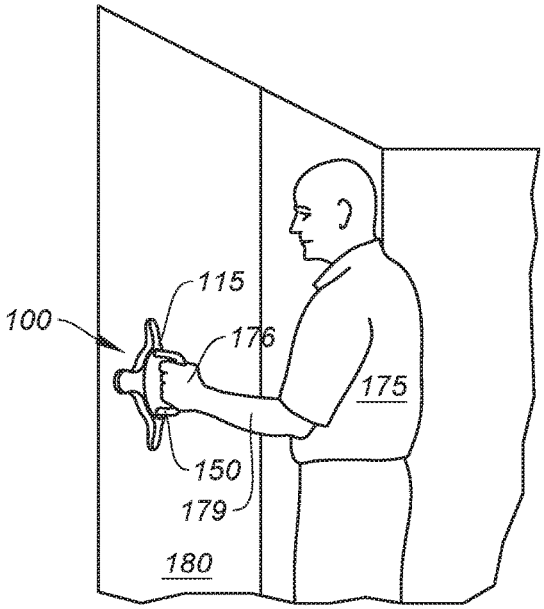
FIGS. 11 through 13 are photographs of the device of FIG. 4 with a user setting up and then performing repetitions of rotating the handle in either direction for supination and pronation of the forearm as part of a first exercise protocol.
Figure 12:
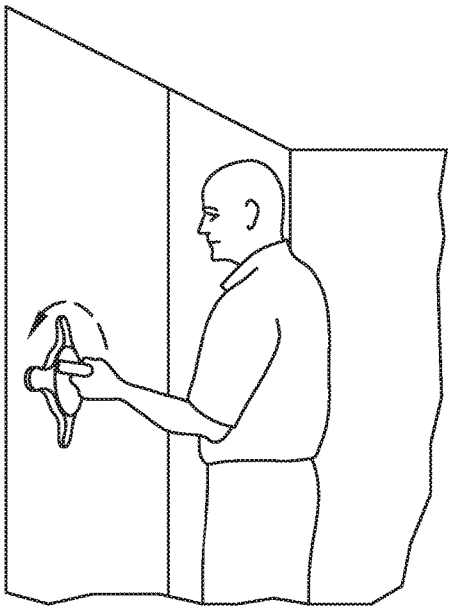
Figure 13:
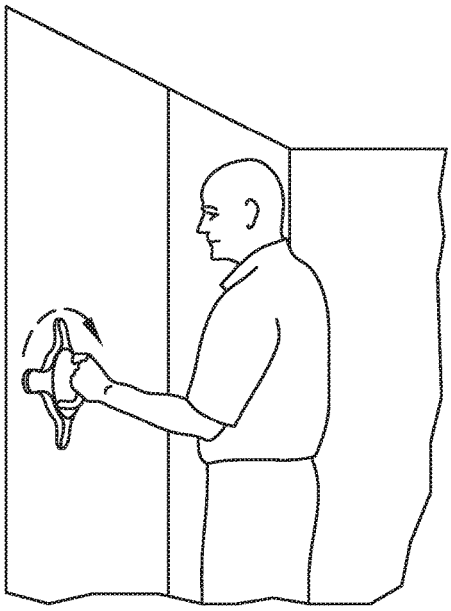

Referring to FIGS. 11 through 13, there is shown photographs of the device of FIG. 4 with a user setting up and then performing repetitions of rotating the handle in either direction for supination and pronation of the forearm as part of a first exercise protocol. The purpose of this exercise protocol for the hand, wrist, and forearm is to provide stability for the hand and elbow, and strength and mobility for the wrist and forearm. Performing the exercise protocol activates and strengthens both the pronators and supinators of the forearm.

By design, the device 100 should be held strongly enough against a vertical surface 180 to keep the feet 117 of legs 115 from slipping and only firmly enough that the device 100 still turns smoothly. Pushing against the surface 180 too hard will cause the device 100 to bind and defeat one key purpose of the exercise, to use the muscles involved in the exercise to control the device 100 rather than leaning against the device 100 with body weight.

In general, this first exercise protocol includes the user 175 initially standing facing the vertical surface 180 at a distance therefrom, and then gripping the handle 150 so it is perpendicular to a ground surface when the device 100 is placed against the vertical surface 180. The user 175 then places the feet 117 flush against the vertical surface 180 with the user 175's arm bent at the elbow at a 90 degree angle, the forearm 179 parallel to the ground surface and upper arm perpendicular to the forearm 179 from their shoulder 177. At this point, user 175 is setup to commence exercise repetitions of the protocol.

User 175 performs a first repetition by rotating the handle 150 outward (see arrow) as far as possible using the forearm 179, wrist and hand 176 and holding for a period of time. This repetition for supination is shown in FIG. 12. Next, and without releasing the tension in the first repetition, user 175 performs a second repetition by rotating the handle 150 further outward using just the wrist and holding for a period of time. Then, and again without releasing the tension in the second repetition, the user 175 performs a third repetition by rotating the handle 150 even further outward using any remaining movement in the forearm 179, wrist and hand 176 and holding for a period of time. At this point, user 175 returns the handle 150 to a neutral position with the handle 150 perpendicular to the ground surface, such as is shown in FIG. 11. This completes the supination portion of the protocol.

For pronation, the user 175 performs a fourth repetition by rotating the handle 150 inward as far as possible handle 150 using the forearm 179, wrist and hand 176 and holding for a period of time. This repetition for pronation is shown in FIG. 13. Next, and without releasing the tension in the fourth repetition, the user 175 performs a fifth repetition by rotating the handle 150 further inward using just the wrist and holding for a period of time. Then, and again without releasing the tension in the fifth repetition, the user 175 performs a sixth repetition by rotating the handle 150 even further inward using any remaining movement in the forearm 179, wrist and hand 176 and holding for a period of time. User 175 finally returns the handle 150 to the neutral position to complete the pronation portion of the first exercise protocol. Accordingly, performing these repetitions activate and strengthen both the pronator and supinator muscles in the user's forearm 179 so as to provide stability for the hand 176 and elbow 178, and strength and mobility for the wrist and forearm 179.

Figure 14:
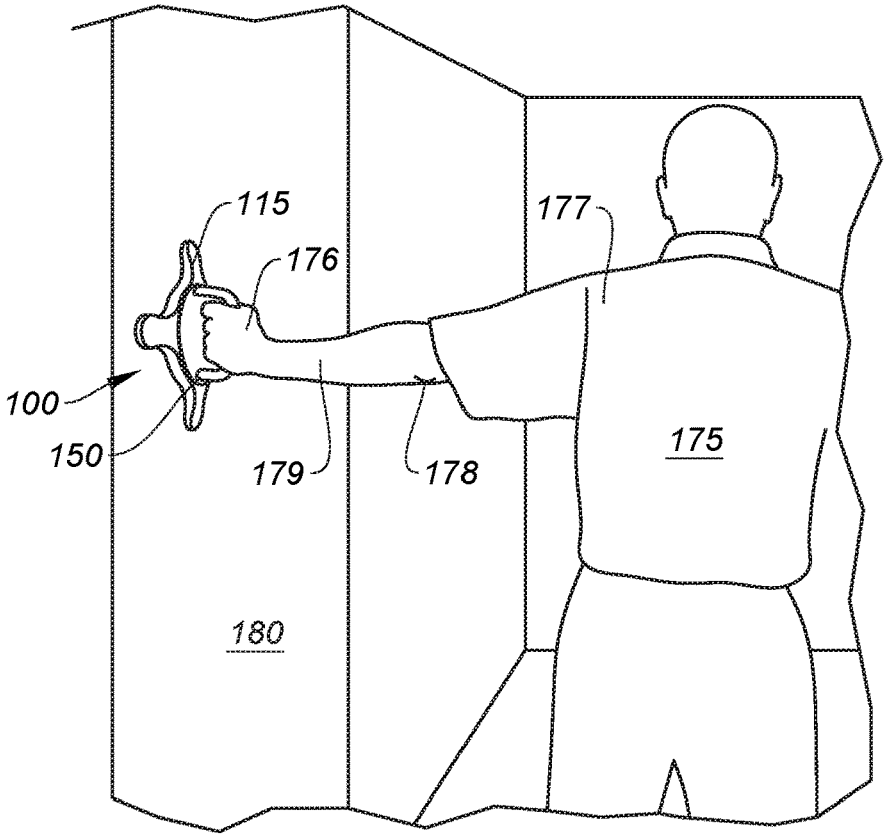
FIGS. 14 and 15 are photographs of the device of FIG. 4 with a user setting up and then performing repetitions of rotating the handle in a single direction for rotating the shoulder and rotator cuff as part of a second exercise protocol.
Figure 15:
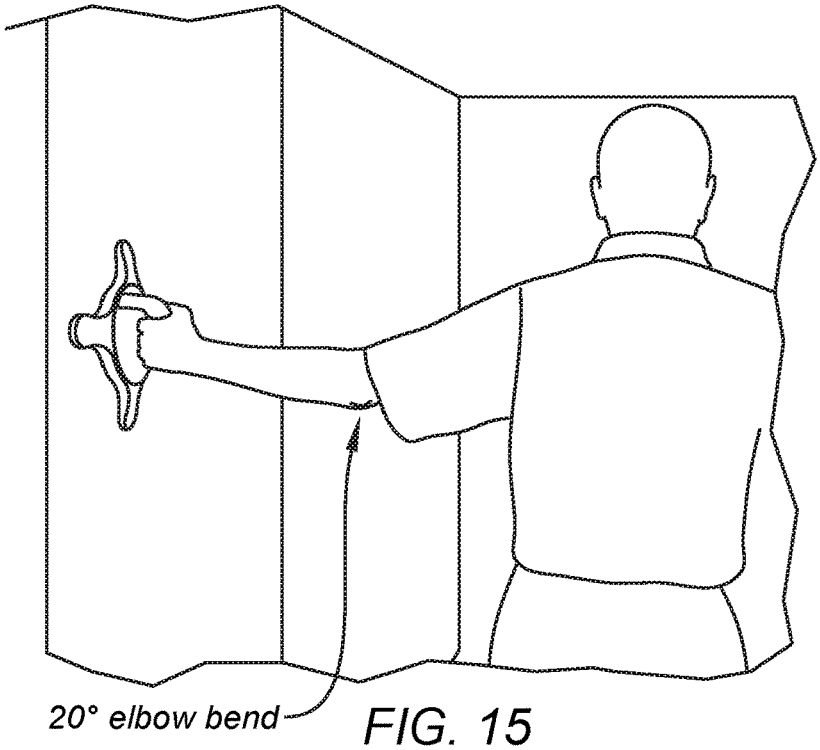

FIGS. 14 and 15 are photographs of the device 100 of FIG. 4 with a user setting up and then the user 175 performs repetitions of rotating the handle 150 in a single direction for rotating the shoulder 177 and rotator cuff as part of a second exercise protocol. The purpose of this exercise protocol for the shoulder 177 and rotator cuff is to provide stability to the shoulder girdle and shoulder blade, while providing mobility to the shoulder joint. This exercise activates and strengthens the muscles of the rotator cuff and improves the overall function of the entire shoulder 177.

As before, device 100 should be held strongly enough against a vertical surface 180 to keep the feet 117 of legs 115 from slipping and only firmly enough that the device 100 still turns smoothly, as pushing against the surface 180 too hard causes binding. The muscles involved in the exercise are to be used to control the device 100 rather than leaning against the device 100 with body weight.

In general, and as shown in FIG. 14, this second exercise protocol includes the user 175 initially standing parallel to the vertical surface at a distance therefrom so that a side of the user 175's body with the shoulder 177 to be exercised is closest thereto. User 175 then grips handle 150 so it is perpendicular to a ground surface when the device 100 is placed against the vertical surface 180, and places the 117 of legs flush against the vertical surface 180 with the user's arm on that side extended and bent at the elbow 178 at approximately a 20 degree angle. At this point, the user 175 is set up so that repetitions may commence.

User 175 performs a first repetition (shown exemplary in FIG. 15) by rotating the handle 150 outward as far as possible handle 150 using the shoulder joint and holding for a period of time. Next, and without releasing the tension in the first repetition, the user 175 performs a second repetition by rotating the handle 150 further outward using the shoulder joint and holding for a period of time. Then, and again without releasing the tension in the second repetition, the user 175 performs a third repetition by rotating the handle 150 even further outward using any remaining movement in the shoulder joint and holding for a period of time, and finally returns handle 150 to the neutral position to complete the second exercise protocol. Accordingly, performing these repetitions activate and release muscles in an around the user 175's shoulder 177, and activates and strengthens the muscles of the rotator cuff so as to provide stability to the shoulder girdle and shoulder blade, while providing mobility to the glenohumeral joint of the shoulder 177.

FIGS. 16 through 20 are photographs of the device 100 of FIG. 4 with a user setting up and then the user 175 performs repetitions of rotating the handle 150 in either direction for supination and pronation of the forearm 179 with the elbow 178 bent and straight as part of a third exercise protocol. The purpose of this exercise protocol for the elbow 178 is to provide stability for the elbow 178 while releasing the muscles and tendons that attach into and around it. The tendons include the biceps tendon and the tendons which attach to the outside, causing tennis elbow, and to the inside, causing golfer's elbow.

As before, device 100 should be held strongly enough against a vertical surface 180 to keep the feet 117 of legs 115 from slipping and only firmly enough that the device 100 still turns smoothly, as pushing against the surface 180 too hard causes binding. The muscles involved in the exercise are to be used to control the device 100 rather than leaning against the device 100 with body weight.

Figure 16:
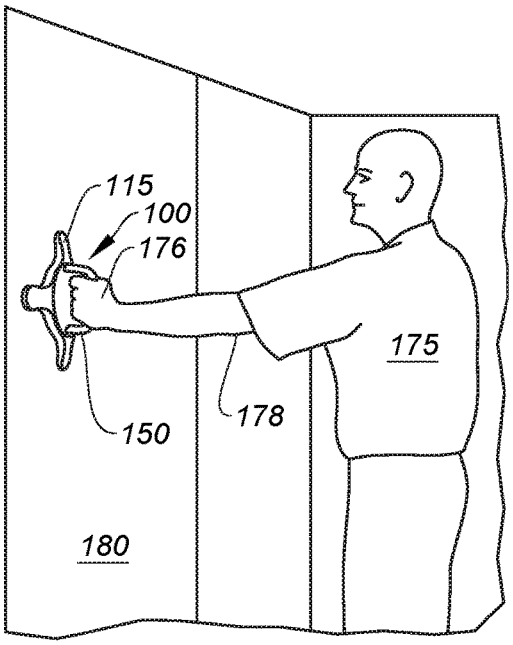
FIGS. 16 through 20 are photographs of the device of FIG. 4 with a user setting up and then performing repetitions of rotating the handle in either direction for supination and pronation of the forearm with the elbow bent and straight as part of a third exercise protocol.

In general, and as shown in FIG. 16, this third exercise protocol includes the user 175 initially standing facing the vertical surface 180 at a distance therefrom so that the shoulders and hips of the user 175 are set at the same distance from vertical surface 180, and then gripping the handle 150 so it is perpendicular to a ground surface when the device 100 is placed against the vertical surface 180. The user 175 then places the feet 117 of legs 115 flush against the vertical surface 180 with the user 175's arm extended substantially straight out in front of the shoulder 177, bent at the elbow at only approximately a 5 degree angle, with the bony tip of the elbow 178 facing toward the ground surface. At this point, user 175 is setup to commence exercise repetitions of the protocol.

Figure 17:
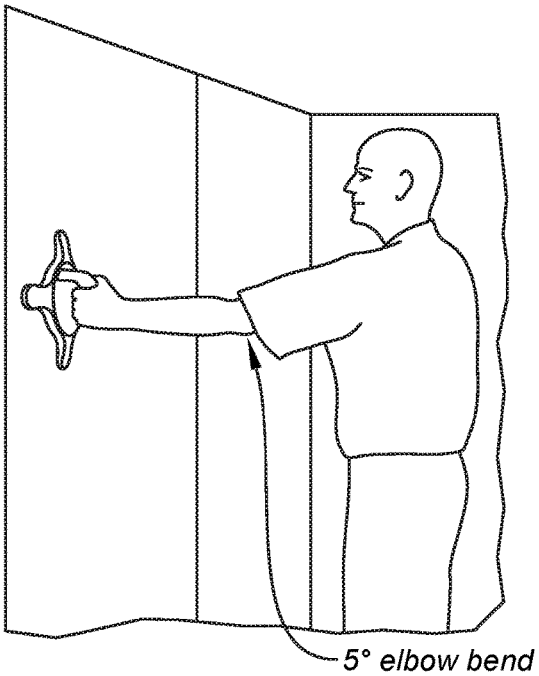
Figure 18:
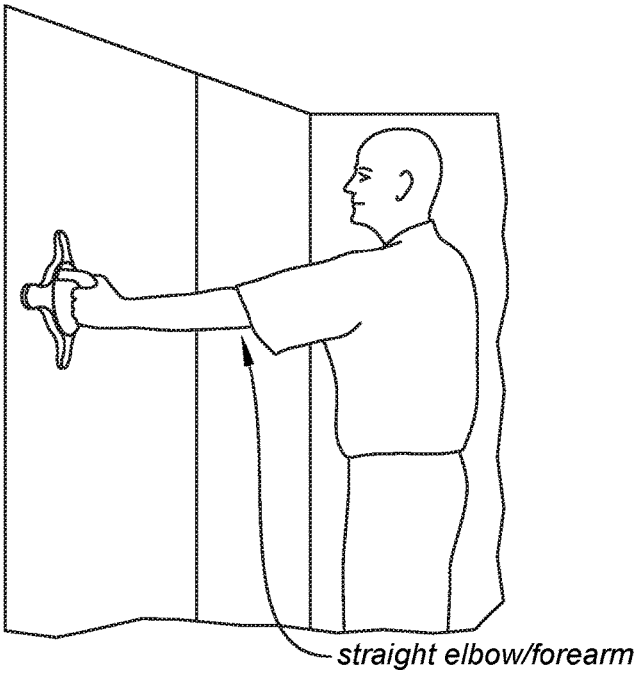

As shown by example in FIG. 17, the user 175 performs a first repetition by rotating the handle 150 outward as far as possible handle 150 using the forearm 179, wrist and hand 176 while the bony tip of the elbow 178 remains facing straight downward, holding for the period of time. Then the user straightens the arm (see FIG. 18) and holds for a period of time to complete the first repetition. Next, and without releasing the tension in the first repetition, the user 175 performs a second repetition by first bending the arm again and rotating the handle 150 further outward using the forearm 179, wrist and hand 176 while the bony tip of the elbow 178 remains facing straight downward, holding for a period of time, and then repeating the straightening of the arm and holding for the period of time to complete the second repetition.

Then, and again without releasing the tension in the second repetition, the user 175 performs a third repetition by bending the arm yet again and rotating the handle 150 even further outward using the forearm 179, wrist and hand 176 while the bony tip of the elbow 178 remains facing straight downward, holds for a period of time, and then repeats the straightening of the arm and holding for the period of time to complete the third repetition, and then returns the handle 150 to the neutral position to complete the elbow supination part of the protocol.

Figure 19:
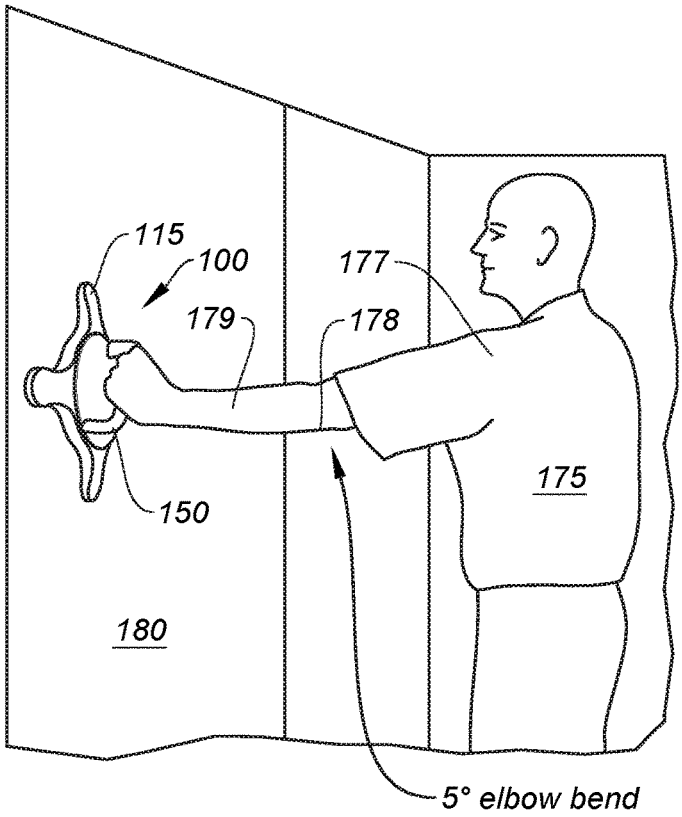
Figure 20:
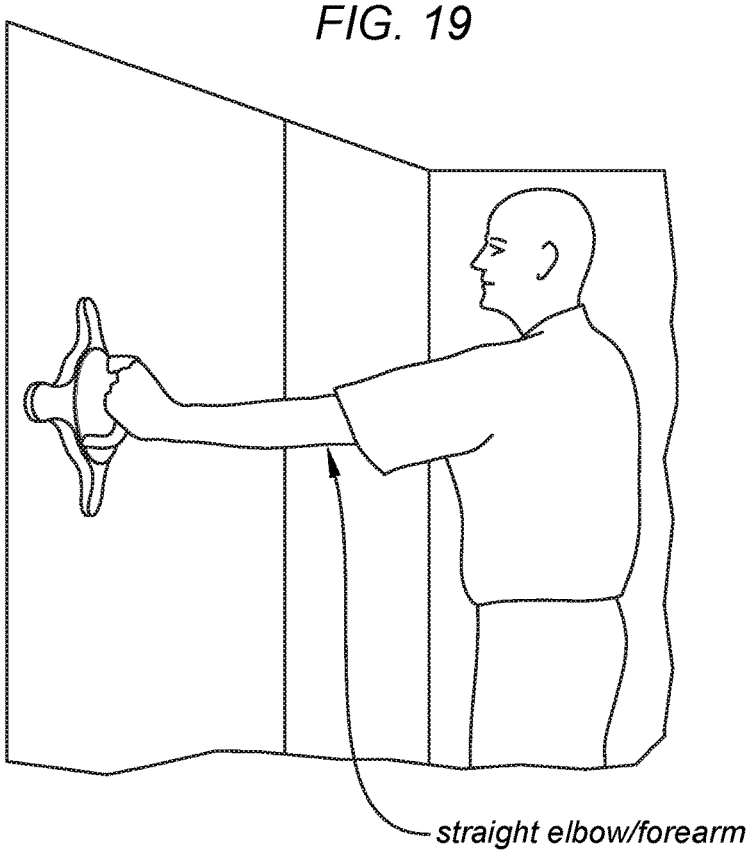

Referring to FIGS. 19 and 20 and for elbow pronation, the user 175 performs subsequent fourth, fifth, and sixth repetitions similar to the first three repetitions, with the exception that the handle 150 is rotated sequentially inward as far as possible in each repetition using the forearm 179, wrist, and hand 176 while the bony tip of the elbow 178 remains facing straight downward, with an intervening step of straightening of the arm and holding for the period of time to complete each repetition before moving to the next. User 175 finally returns the handle 150 to the neutral position to complete the pronation portion of the third exercise protocol.

Accordingly, performing these repetitions releases the user's biceps tendon, releases the tendon at the lateral epicondyle located just above the elbow 178 on the outside thereof, inflammation of which potentially leads to tennis elbow. Performance also releases the tendon at the medial epicondyle located just above the elbow 178 on the inside thereof, inflammation of which potentially leads to golfer's elbow.

Figure 21:
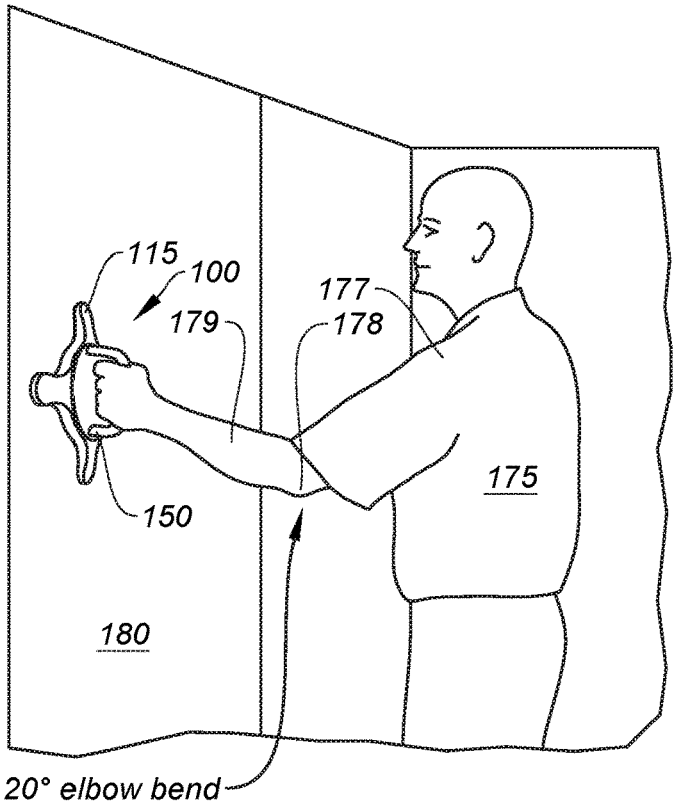
FIGS. 21 and 22 are photographs of the device of FIG. 4 with a user setting up and then performing repetitions of rotating the handle in a single direction for rotating the upper body as part of a fourth exercise protocol.
Figure 22:
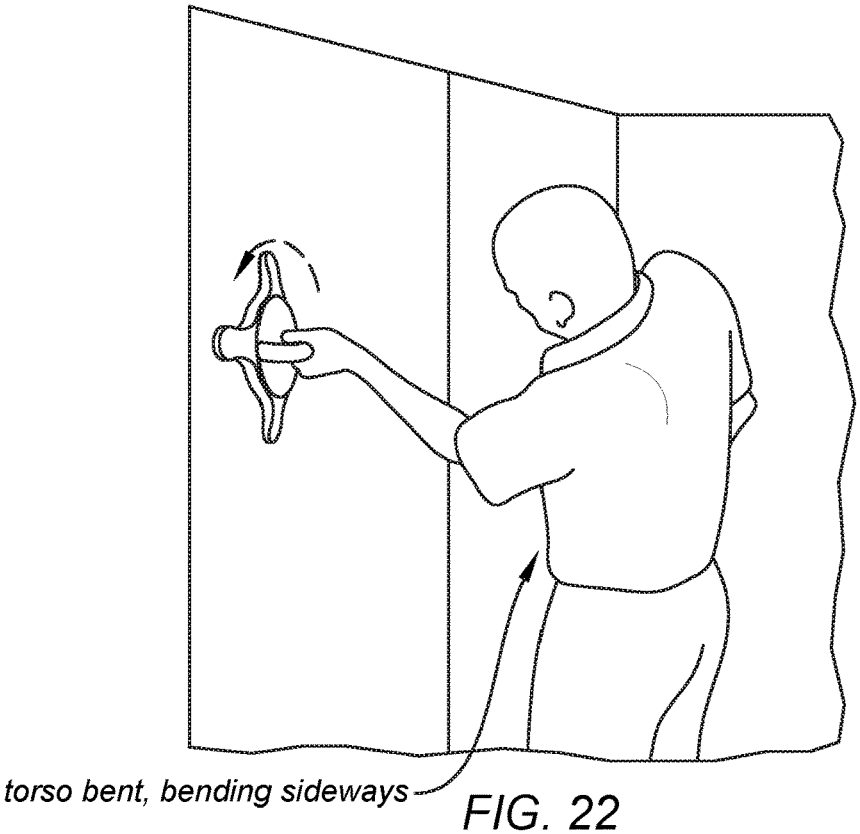

FIGS. 21 and 22 are photographs of the device 100 of FIG. 4 with a user setting up and then the user 175 performs repetitions of rotating the handle 150 in a single direction for rotating the upper body as part of a fourth exercise protocol. The purpose of this exercise protocol for the upper body and lower back is to provide stability to the hand, elbow, shoulder blade, rib cage and inner core muscles. Performance of the protocol with device 100 produces more mobility in the forearm, shoulder joint, and muscles that rotate and bend the spine sideways (the position in which the spine and surrounding muscles are most often injured). It provides more ease of movement and greater stability throughout the entire upper body.

As before, device 100 should be held strongly enough against a vertical surface 180 to keep the feet 117 from slipping and only firmly enough that the device 100 still turns smoothly, as pushing against the surface 180 too hard causes binding. The muscles involved in the exercise are to be used to control the device 100 rather than leaning against the device 100 with body weight.

In general, and as shown in FIG. 21, this fourth exercise protocol includes the user 175 initially standing facing the vertical surface 180 at a distance therefrom so that the shoulders and hips of the user are set at the same distance from vertical surface, then gripping the handle 150 so it is perpendicular to a ground surface when the device 100 is placed against the vertical surface 180. The feet 117 of legs 115 are then placed flush against the vertical surface 180 with the user 175's arm on that side extended and bent at the elbow 178 at approximately a 20 degree angle, so as to be setup for performing repetitions of the protocol.

Referring to FIG. 22 as an exemplary repetition, the user 175 performs a first repetition by rotating the handle 150 outward as far as possible handle 150 using just the hand 176 and wrist, and holding for a period of time. Next, and without releasing the tension in the first repetition, the user 175 performs a second repetition by rotating the handle 150 further outward as far as possible using the wrist and holding for a period of time.

Then, and again without releasing the tension in the second repetition, the user 175 performs a third repetition by rotating the handle 150 even further outward as far as possible using the shoulder 177 and holding for a period of time. Again, and still without releasing the tension in the third repetition, the user 175 performs a fourth repetition by rotating the handle 150 yet further outward by bending sideways as far as possible and holding for a period of time. Handle 150 is then returned to the neutral position to complete the fourth exercise protocol. Accordingly, performance of these repetitions provides stability to the hand, elbow, shoulder blade, rib cage and inner core muscles of the user, and provides additional mobility in the forearm 179, shoulder joint, and muscles that rotate and bend the spine sideways.

The present invention, in its various embodiments, configurations, and aspects, includes components, systems and/or apparatuses substantially as depicted and described herein, including various embodiments, sub-combinations, and subsets thereof. Those of skill in the art will understand how to make and use the present invention after understanding the present disclosure. The present invention, in its various embodiments, configurations, and aspects, includes providing devices in the absence of items not depicted and/or described herein or in various embodiments, configurations, or aspects hereof, including in the absence of such items as may have been used in previous devices, e.g., for improving performance, achieving ease and\or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments, configurations, or aspects for the purpose of streamlining the disclosure. The features of the embodiments, configurations, or aspects of the invention may be combined in alternate embodiments, configurations, or aspects other than those discussed above. This method of disclosure is not to be interpreted as reflecting an intention that the claimed invention requires more features than are expressly recited in each claim. Rather, as the following claims reflect, inventive aspects lie in less than all features of a single foregoing disclosed embodiment, configuration, or aspect. Thus, the following claims are hereby incorporated into this Detailed Description, with each claim standing on its own as a separate preferred embodiment of the invention.

Moreover, though the description of the invention has included description of one or more embodiments, configurations, or aspects and certain variations and modifications, other variations, combinations, and modifications are within the scope of the invention, e.g., as may be within the skill and knowledge of those in the art, after understanding the present disclosure. It is intended to obtain rights which include alternative embodiments, configurations, or aspects to the extent permitted, including alternate, interchangeable and/or equivalent structures to those claimed, whether or not such alternate, interchangeable and/or equivalent structures disclosed herein, and without intending to publicly dedicate any patentable subject matter.

I claim:

1. An exercise device, comprising:

a hollow base, a rotatable plate provided on top of the base and having a handle attached thereon for access by the hand of a user, and a resistance mechanism arranged between the base and rotatable plate, the resistance mechanism further including:

a spring centrally located within the base and terminating in oppositely-extending spring tine ends that are adapted to provide resistance and release of resistance against rotation of the rotatable plate by the user, a first curved ramp provided in the base and oriented so as to extend partially around the spring, the first ramp having flared ends serving as stops, each tine end of the spring biased against a corresponding flared end of the first ramp, and a second curved ramp attached to an underside surface of the rotatable plate so as to be in adjacent relation to the first ramp and adapted to travel in either direction along an inside wall surface of the first ramp, a respective end edge of the second ramp adapted to come into contact with one of the oppositely-extending spring tine ends depending on the direction of rotation of the plate.

2. The device of claim 1, wherein, with the user standing in spaced relation to vertical planar surface and facing parallel thereto, their arm outstretched from the shoulder and grasping the handle and feet firmly set in fixed relation on a ground surface so that the device is immovable along the vertical planar surface, the handle is adapted to be rotated in a direction where the user's forearm is rotated outward, then inward, the exercising action of which substantially activates the muscles that supinate, then pronate, the forearm and substantially release the muscles that pronate and supinate the forearm.

3. The device of claim 2, wherein the exercising action in rotating the handle activates and strengthens both the pronator and supinator muscles in the forearm of the user so as to provide stability for the user's hand and elbow, and strength and mobility for the wrist and forearm.

4. The device of claim 1, wherein, with the user standing in spaced relation to and facing directly to a vertical planar surface, their arm outstretched from the shoulder and grasping the handle and feet firmly set in fixed relation on a ground surface so that the device is immovable along the vertical planar surface, the handle in an exercise action is adapted to be rotated by the user to perform a posterior shoulder rotation exercise in order to activate at least one or more of the infraspinatus, teres minor, and posterior deltoid muscles of the user, and to release at least one or more of the latissimus dorsi, subscapularis, teres major, and anterior deltoid muscles of the user.

5. The device of claim 4, wherein the exercising action in rotating the handle to activate and release muscles in and around the user's shoulder activates and strengthens the muscles of the user's rotator cuff so as to provide stability to the shoulder girdle and shoulder blade of the user, while providing mobility to the user's glenohumeral joint of the shoulder.

6. The device of claim 1, wherein, with the user standing in spaced relation to a textured vertical surface and facing directly to a vertical planar surface, their arm bent at the elbow at an approximately 5 degree angle with the user's forearm parallel to a ground surface and the user's upper arm above the forearm vertical from their shoulder and grasping the handle, the user's feet firmly set in fixed relation on the ground surface so that the device is immovable along the textured vertical surface, the handle in an exercise action is adapted to be rotated by turning the forearm, wrist and hand outward as far as possible, in order to provide stability for the elbow by releasing muscles and tendons that attach into or around the elbow, whereby the elbow is straightened at the termination of each rotation, eccentrically stretching the biceps tendon and tendons that attach to the lateral and medial epicondyles.

7. The device of claim 6, wherein the exercising action in rotating the handle and then straightening the elbow releases the biceps tendon of the user, releases the tendon at the lateral epicondyle located just above the elbow of the user on the outside thereof, inflammation of which potentially leads to tennis elbow, and releases the tendon at the medial epicondyle located just above the elbow of the user on the inside thereof, inflammation of which potentially leads to golfer's elbow.

8. The device of claim 1, wherein, with the user standing in spaced relation to a textured vertical surface and facing directly thereat with the hips and shoulders square to the vertical surface, their arm bent at the elbow at about a 20 degree angle and grasping the handle, the user's feet firmly set in fixed relation on a ground surface so that the device is immovable along the textured vertical surface, an exercise action is performed by the user rotating the handle, in the same direction and in sequence, using just the hand and wrist of the bent arm, then just the forearm of the bent arm, then just the shoulder on the side of the bent arm, then just by bending sideways as far as possible, in order to provide stability to the hand, elbow, shoulder blade, rib cage and inner core muscles of the user, and to provide additional mobility in the forearm, shoulder joint, and muscles that rotate and bend the spine sideways.

9. A handheld resistance exercise device usable by a user to improve stability and mobility in muscles, tendons, joints, and fasciae in the upper body and lower back thereof, the device supportable by the user in fixed relation against a vertical planar surface for exercise, comprising:

a hollow base having a central circular opening in a top surface thereof that is bounded by a circumferential inner vertical wall to define a cavity therein, the top surface of the base including a plurality of separate legs extending outward from the cavity, each leg terminating in a foot at a distal underside end thereof that comes into flush contact with the vertical planar surface as the device is held in fixed contact against the vertical planar surface by the user for exercise, a rotatable plate provided on top of the base over the cavity, an outer surface thereof serving as the top surface of the device and having a handle attached thereon for access by the hand of the user, and a resistance mechanism arranged within the cavity so as to be sandwiched between and attached to each of the base and rotatable plate, the resistance mechanism further including:

a single spring centrally located in the center of the cavity and terminating in oppositely-extending spring tine ends, the tine ends of the spring adapted to provide resistance and release of resistance against rotation of the plate by the user, a first semicircular ramp arranged in the cavity between the circumferential inner vertical wall of the base and the central spring, the ramp having flared ends serving as stops, each tine end of the central spring biased against a corresponding stop of the first ramp, and a second semicircular ramp extending from an underside surface of the plate so as to be in adjacent relation to the first semicircular ramp and adapted to travel in either direction along an inside wall surface of the first ramp, a respective end edge of the second ramp adapted to come into contact with one of the oppositely-extending spring tine ends depending on the direction of rotation of the plate, wherein only one tine end of the spring applies resistance against rotation of the plate at any one time depending on the direction of rotation.

10. The device of claim 9, wherein each foot is composed of an elastomeric material, with only the feet adapted to contact the vertical planar surface.

11. The device of claim 9, further comprising a circular bearing ring arranged within the cavity, the bearing ring having a width and a top surface on which is formed a plurality of spaced hemispherical bearings integrally formed therewith to facilitate rotation of the plate relative to the base.

12. A method by which a user performs an exercise protocol using the exercise device of claim 1, the method comprising:

standing facing vertical surface at a distance therefrom, gripping the handle so the handle is perpendicular to a ground surface when the device is placed against the vertical surface, placing the bottom of the device flush against the vertical surface with the user's arm bent at the elbow at a 90 degree angle, the forearm of the bent arm parallel to the ground surface and the upper arm thereof perpendicular to the forearm from their the corresponding shoulder, performing a first repetition by rotating the handle outward from a neutral position as far as possible using the forearm and corresponding wrist and hand and holding for a period of time, without releasing the tension in the first repetition, performing a second repetition by rotating the handle further outward using just the wrist and holding for a period of time, and without releasing the tension in the second repetition, performing a third repetition by rotating the handle even further outward using any remaining movement in the forearm, wrist and hand and holding for a period of time, returning the handle to the neutral position with the handle perpendicular to the ground surface, performing a fourth repetition by rotating the handle inward as far as possible handle using the forearm, wrist and hand and holding for a period of time, without releasing the tension in the fourth repetition, performing a fifth repetition by rotating the handle further inward using just the wrist and holding for a period of time, and without releasing the tension in the fifth repetition, performing a sixth repetition by rotating the handle even further inward using any remaining movement in the forearm, wrist and hand and holding for a period of time, returning the handle to the neutral position to complete the exercise protocol.

13. The method of claim 12, wherein performing the repetitions activates and strengthens both the pronator and supinator muscles in the user's forearm so as to provide stability for the hand and elbow, and strength and mobility for the wrist and forearm.

14. A method by which a user performs an exercise protocol using the exercise device of claim 1, the method comprising:

standing parallel to vertical surface at a distance therefrom so that a shoulder is to be exercised that is closest thereto, gripping the handle so the handle is perpendicular to a ground surface when the device is placed against the vertical surface, placing the bottom of the device flush against the vertical surface with the user's arm on that side extended and bent at the elbow at approximately a 20 degree angle, performing a first repetition by rotating the handle outward from a neutral position as far as possible using the shoulder joint above the user's bent arm and holding for a period of time, without releasing the tension in the first repetition, performing a second repetition by rotating the handle further outward using the shoulder joint and holding for a period of time, without releasing the tension in the second repetition, performing a third repetition by rotating the handle even further outward using any remaining movement in the shoulder joint and holding for a period of time, and returning the handle to the neutral position with the handle perpendicular to the ground surface to complete the exercise protocol.

15. The method of claim 14, wherein performing the repetitions activate and release muscles in an around the user's shoulder activates and strengthens the muscles of the rotator cuff so as to provide stability to the shoulder girdle and shoulder blade, while providing mobility to the glenohumeral joint of the shoulder.

16. A method by which a user performs an exercise protocol using the exercise device of claim 1, the method comprising:

standing facing vertical surface at a distance therefrom so that the shoulders and hips of the user are set at the same distance from the vertical surface, gripping the handle so the handle is perpendicular to a ground surface when the device is placed against the vertical surface, placing a bottom of the device flush against the vertical surface with the user's arm extended substantially straight out in front of the shoulder, with the arm bent at the elbow at approximately a 5 degree angle, a bony tip of the elbow facing toward the ground surface, performing a first repetition by rotating the handle outward from a neutral position as far as possible using the forearm, wrist and hand of the bent arm while the bony tip of the elbow remains facing straight downward, straightening the arm and holding for a period of time to complete the first repetition, without releasing the tension in the first repetition, performing a second repetition by first bending the arm again and rotating the handle further outward using the forearm, wrist and hand while the bony tip of the elbow remains facing straight downward, repeating the straightening of the arm and holding for the period of time to complete the second repetition, without releasing the tension in the second repetition, performing a third repetition by bending the arm yet again and rotating the handle even further outward using the forearm, wrist and hand while the bony tip of the elbow remains facing straight downward, repeating the straightening of the arm and holding for the period of time to complete the third repetition, returning the handle to the neutral position, performing subsequent fourth, fifth, and sixth repetitions similar to the first three repetitions, with the exception that the handle is rotated sequentially inward as far as possible in each repetition using the forearm, wrist and hand while the bony tip of the elbow remains facing straight downward, with an intervening step of straightening of the arm and holding for the period of time to complete each repetition before moving to the next, and returning the handle to the neutral position to complete the exercise protocol.

17. The method of claim 16, wherein performing the repetitions releases the user's biceps tendon, releases the tendon at the lateral epicondyle located just above the elbow on the outside thereof, inflammation of which potentially leads to tennis elbow, and releases the tendon at the medial epicondyle located just above the elbow on the inside thereof, inflammation of which potentially leads to golfer's elbow.

18. A method by which a user performs an exercise protocol using the exercise device of claim 1, the method comprising:

standing facing vertical surface at a distance therefrom so that the shoulders and hips of the user are set at the same distance from the vertical surface, gripping the handle so the handle is perpendicular to a ground surface when the device is placed against the vertical surface, placing a bottom of the device flush against the vertical surface with the user's arm on that side extended and bent at the elbow at approximately a 20 degree angle, performing a first repetition by rotating the handle outward from a neutral position as far as possible using just the hand and wrist of the bent arm, and holding for a period of time, without releasing the tension in the first repetition, performing a second repetition by rotating the handle further outward as far as possible using the wrist and holding for a period of time, and without releasing the tension in the second repetition, performing a third repetition by rotating the handle even further outward as far as possible using the shoulder and holding for a period of time, without releasing the tension in the third repetition, performing a fourth repetition by rotating the handle yet further outward by bending sideways to the side of the bent arm as far as possible and holding for a period of time, and returning the handle to a neutral position with the handle perpendicular to the ground surface to complete the exercise protocol.

19. The method of claim 18, wherein performing the repetitions provides stability to the hand, elbow, shoulder blade, rib cage and inner core muscles of the user, and provides additional mobility in the forearm, shoulder joint, and muscles that rotate and bend the spine sideways.

* * * * *